US007935199B2

(12) United States Patent
Mochida et al.

(10) Patent No.: US 7,935,199 B2
(45) Date of Patent: May 3, 2011

(54) PRINTER-LABELER AND LABELER

(75) Inventors: Sadayoshi Mochida, Shizuoka (JP); Shinichi Kashiwagi, Shizuoka (JP); Takashi Sekimoto, Osaka (JP)

(73) Assignees: Toshiba Tec Kabushiki Kaisha, Tokyo (JP); Takara Pac Ltd., Tokyo (JP)

( * ) Notice: Subject to any disclaimer, the term of this patent is extended or adjusted under 35 U.S.C. 154(b) by 264 days.

(21) Appl. No.: 12/205,034

(22) Filed: Sep. 5, 2008

(65) Prior Publication Data

US 2009/0065151 A1 Mar. 12, 2009

(30) Foreign Application Priority Data

Sep. 7, 2007 (JP) ..... 2007-233404

(51) Int. Cl.
*B32B 41/00* (2006.01)

(52) U.S. Cl. ..... 156/64; 156/351; 156/352; 156/361; 156/364; 156/367; 156/368

(58) Field of Classification Search ..... 156/64, 156/351, 352, 361, 364, 367, 368, 387, 388, 156/566, 567, 568, DIG. 40, DIG. 44, DIG. 45
See application file for complete search history.

(56) References Cited

U.S. PATENT DOCUMENTS

| | | | | |
|---|---|---|---|---|
| 6,053,231 | A * | 4/2000 | Matsuguchi | 156/378 |
| 6,280,544 | B1 | 8/2001 | Fox et al. | |
| 2004/0000369 | A1 | 1/2004 | Pituch et al. | |
| 2005/0219051 | A1 | 10/2005 | Nedblake | |
| 2006/0144521 | A1 | 7/2006 | Esposito et al. | |
| 2007/0187501 | A1 | 8/2007 | Lenkl et al. | |
| 2007/0221319 | A1 | 9/2007 | Morgan | |
| 2007/0284049 | A1 * | 12/2007 | Ford et al. | 156/541 |

FOREIGN PATENT DOCUMENTS

| | | | |
|---|---|---|---|
| DE | 102005018192 | A1 | 10/2006 |
| EP | 1 829 784 | A1 | 9/2007 |
| JP | 2005-119687 | A | 5/2005 |

OTHER PUBLICATIONS

Extended European Search Report dated Dec. 23, 2008, issued in a counterpart European Application.

* cited by examiner

*Primary Examiner* — George R Koch, III
(74) *Attorney, Agent, or Firm* — Holtz, Holtz, Goodman & Chick, PC

(57) ABSTRACT

When a label on a conveyor belt is detected, there is performed a label sticking process of making a sticking mechanism take out the label and stick it to an article at a predetermined position, while when a defect of the label on the conveyor belt is detected before detecting the label, the label is sent out to a label recovery position without performing the label sticking process.

7 Claims, 8 Drawing Sheets

PRINTER-LABELER AND LABELER

CROSS REFERENCE TO RELATED APPLICATION

The present application is based on and claims the benefit of priority of Japanese Patent Application No. 2007-233404 filed on Sep. 7, 2007, the entire content of which is incorporated herein by reference.

BACKGROUND OF THE INVENTION

1. Field of the Invention

The present invention relates to a printer-labeler and a labeler.

2. Discussion of the Background

Heretofore there has been known a printer-labeler comprising a printer and a labeler both arranged side by side. In the printer section there are performed write of RFID data for an RFID tag of a label, printing to the label on the basis of printing data, and peeling of the label from base paper by turning up the label with a peeling edge (Japanese Laid-Open Publication No. 2005-119687) (Patent Literature 1). Though not clearly shown in Patent Literature 1, there is known a printer-labeler wherein in the labeler section, chucking of a label with a chucking head and sticking of the label by displacement of the chucking head are performed.

There sometimes is a case where a trouble caused for example by a defect of an RFID tag incorporated occurs in a label. Such a trouble of the label can be detected for example by infeasible communication by an RFID reader-writer. A label found to be defective is necessary to be removed promptly before being stuck on an object to be labeled.

In this connection, in Japanese Laid-Open Publication No. 2005-119687 there is described a technique such that when a defect of a label has been detected, a turn-up angle at a peeling edge is made obtuse to wind up the label together with the base paper without peeling the label. Consequently, the label found to be defective is removed before being stuck onto an object to be labeled.

However, in case of adopting the technique described in Patent Literature 1 and in case of using a label which is long in the conveyance direction, there arises the problem that when a defect is detected by the RFID reader-writer, the label tip has already reached the peeling edge and peeling started. In this case it is impossible to remove the label found defective.

To solve this problem there have heretofore been adopted methods wherein the label found defective is removed after peeling the label.

According to a first conventional method, the label found defective is chucked by a chucking head after peeling the label and is moved to a position different from the position of a work as an object to be labeled.

According to a second conventional method, after peeling the label found defective, air is ejected to the same label to blow off the label.

However, in case of adopting the above two methods, there arise the following problems respectively.

In case of adopting the first method, there arises the need of separately providing a complicated mechanism for moving the chucking head to a position different from the position of the work.

In case of adopting the second method, the label may not be surely removed because the destination of the label which is blown off by the ejection of air is not definite.

SUMMARY OF THE INVENTION

It is an object of the present invention to positively remove a label found defective without the need of any complicated mechanism.

The printer-labeler of the present invention comprises a conveying unit for the conveyance of label paper with labels affixed to base paper, a printing unit to make printing to the labels, a label peeling unit for peeling each of the labels from the base paper, a conveyor belt for conveying the peeled label toward a predetermined label recovery position, and a sticking mechanism for taking out the label on the conveyor belt and sticking it to an article at a predetermined position. According to the printer-labeler of the present invention, when a label sensor detects a label on the conveyor belt, a label sticking process is carried out by the sticking mechanism, while when a defect of the label is detected before the label sensor detects the label, the label sticking process is not carried out, but the conveyor belt is operated to send the label to the label recovery position.

The labeler of the present invention comprises a conveyor belt for conveying a label peeled from label paper toward a predetermined label recovery position and a sticking mechanism for taking out the label on the conveyor belt and sticking it to an article at a predetermined position. According to the labeler of the present invention, when a label sensor detects a label on the conveyor belt, a label sticking process is carried out by the sticking mechanism, while when a defect of the label is detected before the label sensor detects the label, the label sticking process is not carried out, but the conveyor belt is operated to send the label to the label recovery position.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

A printer-labeler and a labeler both embodying the present invention will be described below with reference to FIGS. 1 to 8.

Figure 1:
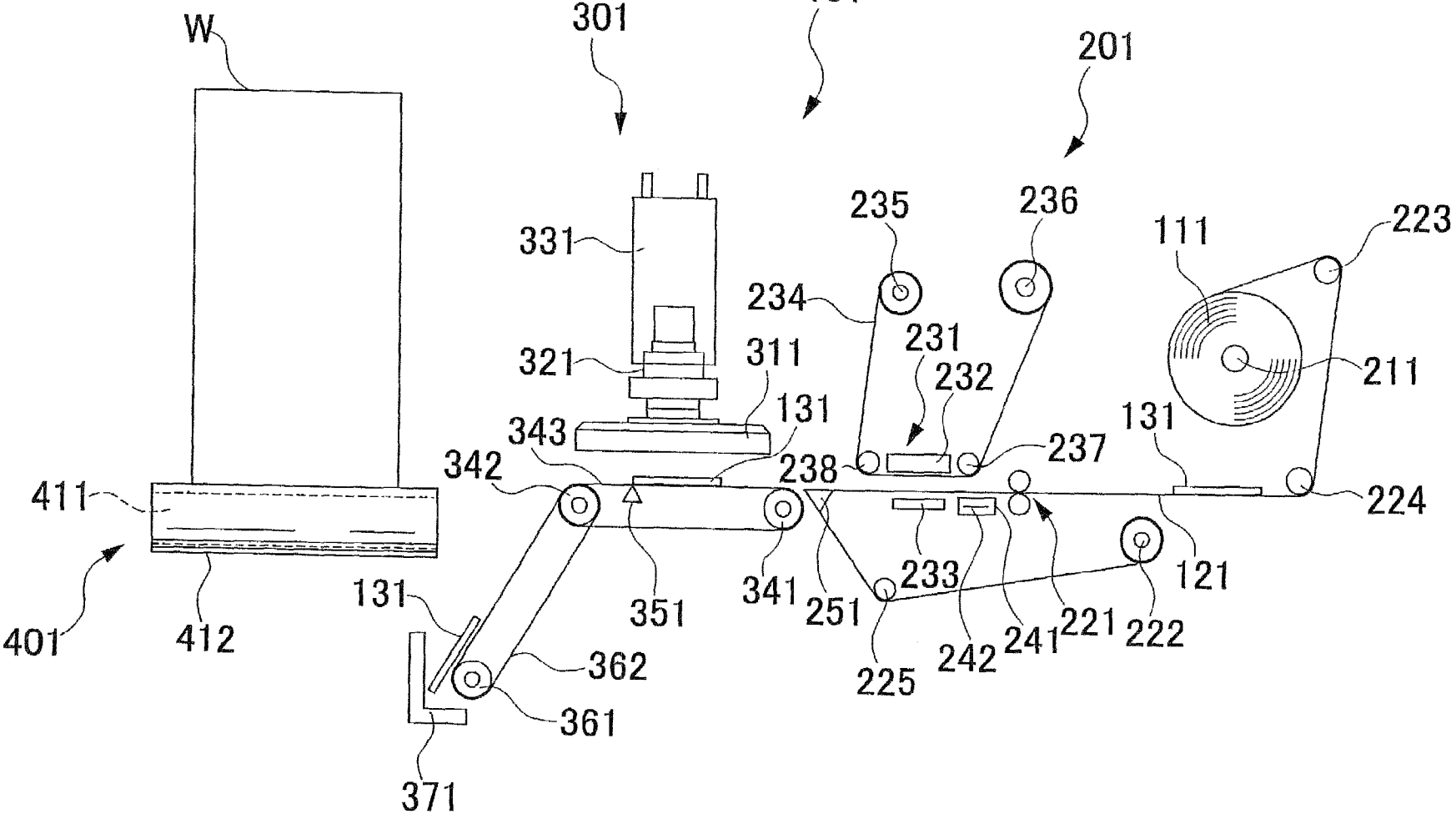
FIG. 1 is a side view showing a printer-labeler schematically.

As shown in FIG. 1, a printer-labeler 101 embodying the present invention is mainly composed of a printer 201 and a labeler 301 which are disposed side by side. A work conveying unit 401 is disposed adjacent to the printer-labeler 101. The work conveying unit 401 conveys a work W, which is an object to which a label 131 is to be stuck, to a position confronting the labeler 301.

A description will be given first about the printer 201. Within a housing (not shown) of the printer 201 there is disposed a holding shaft 211 which holds rolled label paper 111 rotatably. The label paper 111 has a construction such that plural labels 131 are arranged at predetermined certain intervals on a long base paper 121 (see FIG. 2).

The label paper 111 held by the holding shaft 211 is drawn out and conveyed by conveying rollers 221 and is eventually wound up by a base paper take-up shaft 222. The conveying rollers 221 are composed of a driving roller and a driven roller. The label paper 111 is conveyed while being entrained on auxiliary rollers 223, 224 and 225, whereby tension is generated in the label paper 111 during conveyance.

An RFID reader-writer 241 is disposed in a conveyance path of the label paper 111. During conveyance of the label paper 11, the RFID reader-writer 241 performs radio communication with and a label 131 positioned above the reader-writer to read of write data from or to the label 131. The RFID reader-writer 241 incorporates a reader-writer antenna 242 for performing such a radio communication.

Figure 2:
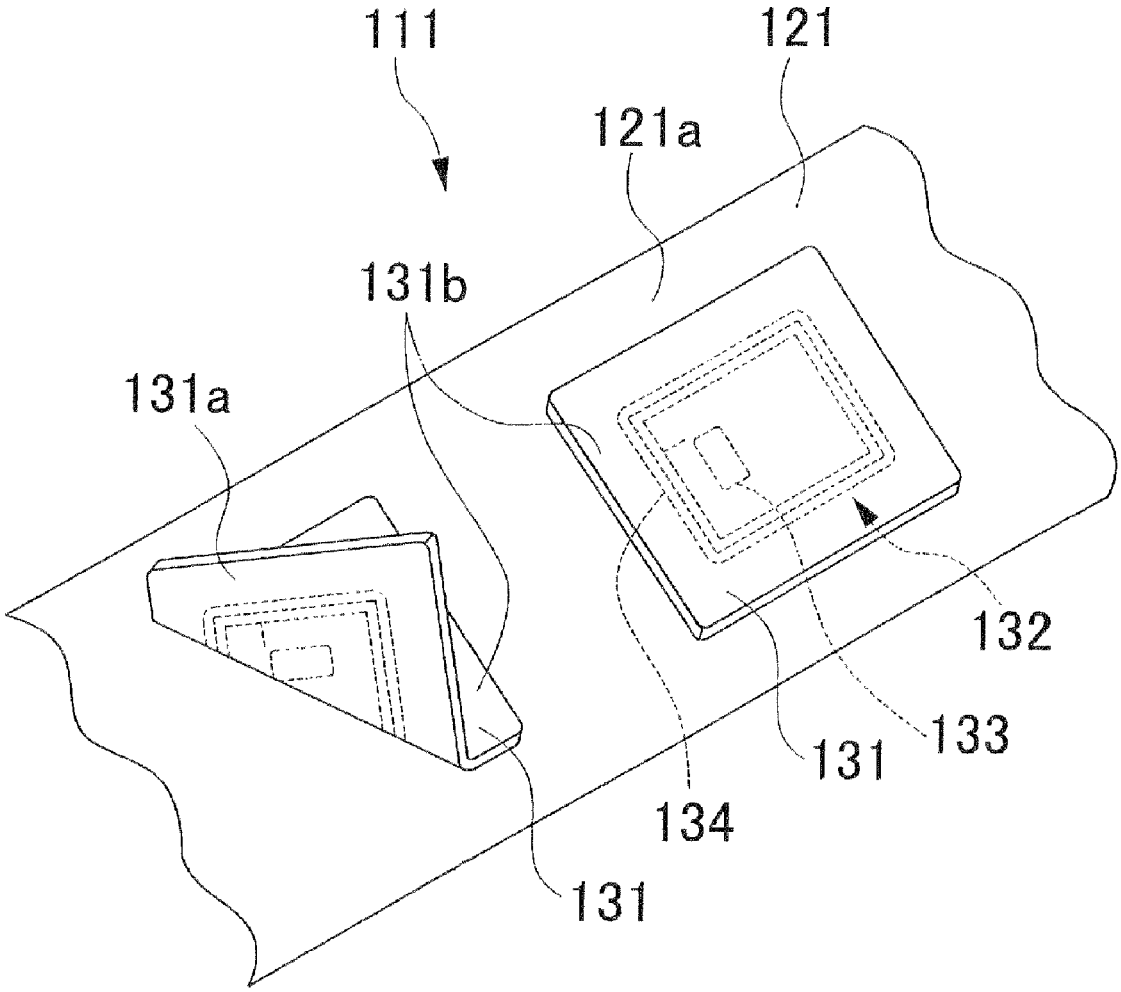
FIG. 2 is a perspective view showing label paper.

As shown in FIG. 2, a peeling surface 121*a* having been subjected to a mold release process is formed on one surface of the base paper 121. Further, a sticking surface 131*a* having an adhesive layer is formed on the side opposite to a printing surface 131*b* of each label 131. The adhesive layer of the sticking surface 131*a* of each label 131 sticks on the peeling surface 121*a* of the base paper 121. As a result, the label 131 is held by the base paper 121.

An RFID tag 132 indicated by broken lines is incorporated in each label 131. The RFID tag 132 is made up of an IC chip 133 and an antenna 134 connected to the IC chip 133. The RFID tag 132 is a passive type tag not incorporating a battery. In this embodiment, as an example, the RFID tag 132 is supplied with power by an electromagnetic induction method which utilizes UHF band or a frequency band of 13.56 MHz. That is, in the RFID tag, the built-in antenna 134 receives a magnetic field from the reader-writer antenna, thereby generating electric power. The IC chip 133 is turned ON by this electric power. It becomes possible for the RFID tag 132 with the IC chip 133 turned ON and the RFID reader-writer 241 to communicate with each other by radio.

Referring back to FIG. 1, a printing unit 231 is disposed downstream of the RFID reader-writer in the conveyance direction of the label paper 111 to make printing to the printing surface 131*b* (see FIG. 2) of each label 131. The printing unit 231 is mainly composed of a printing head 232 and a platen 233 which are disposed in opposition to each other through the conveyance path of the label paper 111. An ink ribbon 234 is passed between the printing head 232 and the platen 233. More particularly, within the housing, a rolled ink ribbon 234 is held rotatably by an ink ribbon holding shaft 236. The ink ribbon 234 held by the ink ribbon holding shaft 236 is entrained on both auxiliary rollers 237 and 238 which are disposed upstream and downstream, respectively of the printing head 232 in the conveyance direction of the label paper 111. The ink ribbon 234 is conveyed by being wound up by a ribbon take-up shaft 235.

When the printing head 232 is pushed in a heat-generated state thereof to the platen 233 through the ink ribbon 234, the ink ribbon 234 melts and printing is made to the printing surface 131*b* of the label 131 concerned.

A peeling edge 251 is disposed downstream of the printing unit 231 in the conveyance direction of the label paper 111. The peeling edge 251 has a sharp turn-up end. The label paper 111 is entrained on the turn-up end of the peeling edge 251. As the label paper 111 is conveyed along the peeling edge 251, the label 131 concerned is peeled from the base paper 121 at the turn-up end and is fed toward the labeler 301. Only the base paper 121 is wound up onto the base paper take-up shaft 222.

Figure 3:
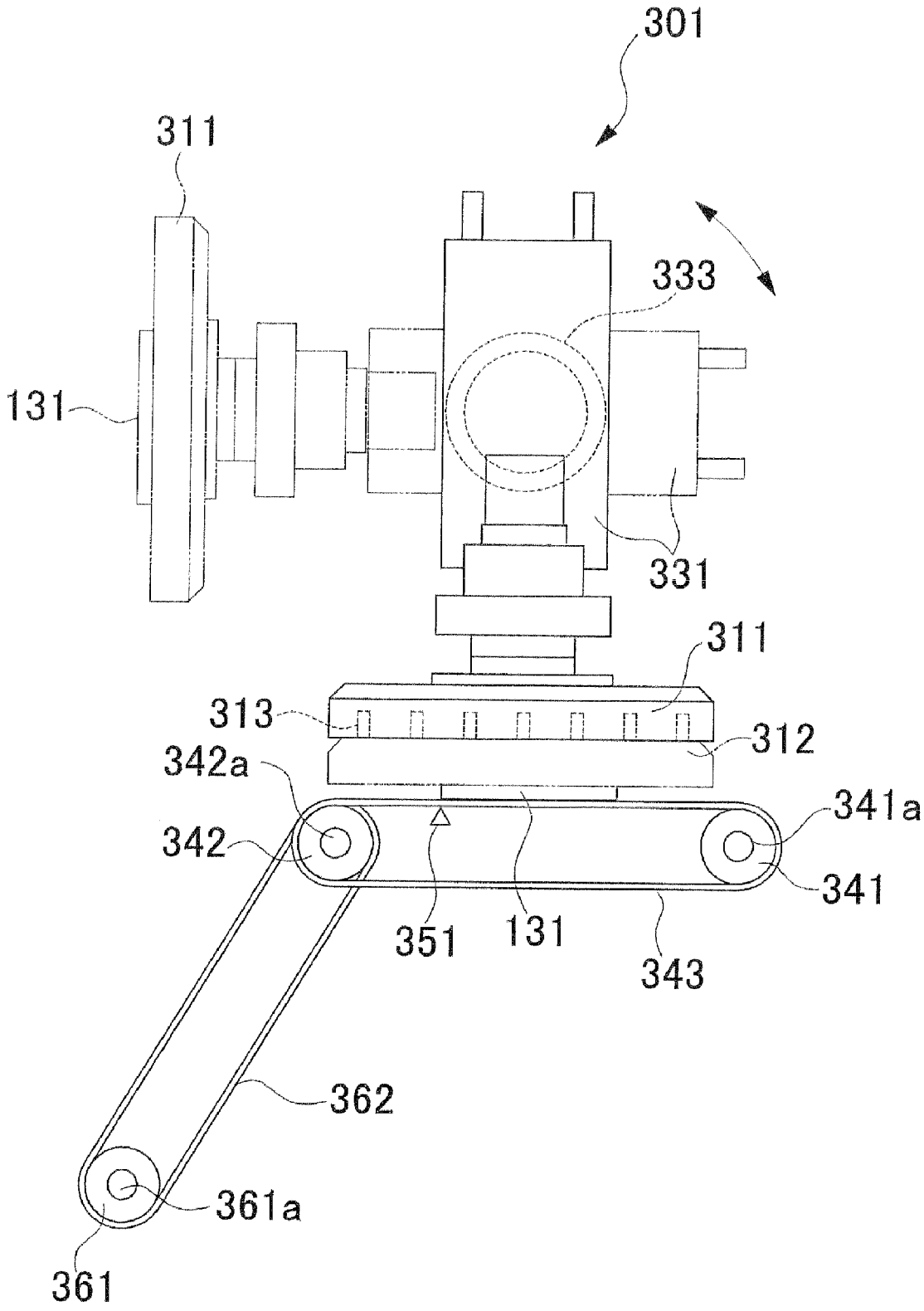
FIG. 3 is a side view showing a labeler.

As shown in FIG. 3, the labeler 301 includes a first driven roller 341, a driving roller 342 and a second driven roller 361. The first driven roller 341 is disposed at a position where it receives the label 131 peeled by the peeling edge 251 (see FIG. 1) in the printer 201. The driving roller 342 is positioned on the work conveying unit 401 (see FIG. 1) side with respect to the first driven roller 341. The second driven roller 361 is positioned on the work conveying unit 401 side and a lower side with respect to the driving roller 342. The first driven roller 341 and the driving roller 342 are disposed horizontally.

Rotational axes of the first driven roller 341, driving roller 342 and second driven roller 361 are parallel to rotational axes of various rollers, including the conveying rollers 221, of the printer 201 and shafts thereof. A first conveyor belt 343 is entrained on the first driven roller 341 and the driving roller 342. Likewise, a second conveyor belt 362 is entrained on the driving roller 342 and the second driven roller 361. The first and second conveyor belts 343 and 362 are non-adhesive silicon belts.

A rotational driving force of a motor 382 (see FIG. 6) is transmitted to the driving roller 342 via a power transfer mechanism 344 which is constituted by gears, etc., thereby causing the roller 342 to rotate. Once the driving roller 342 rotates, the first conveyor belt 343 rotates with rotation of the first driven roller 341 and so does the second conveyor belt 362 with rotation of the second driven roller 361.

Figure 4:
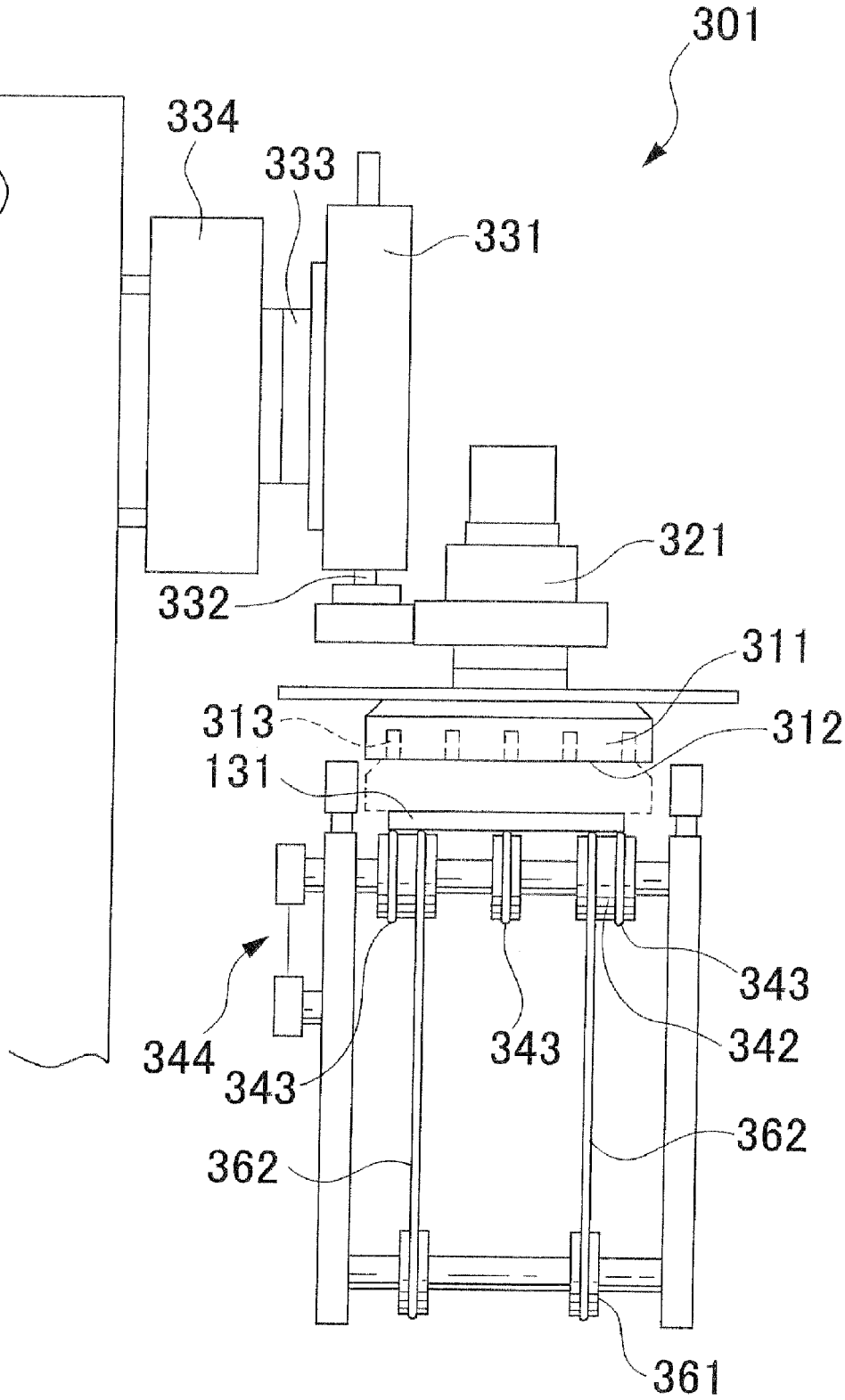
FIG. 4 is a front view showing the labeler.

Three first driven rollers 341 and three driving rollers 342 are disposed along roller shafts 341*a* and 342*a*, respectively. Two second driven rollers 361 are disposed along a roller shaft 361*a*. The first conveyor belt 343 comprises three thin O-ring belts, while the second conveyor belt 362 comprises two thin O-ring belts. Grooves for fitting therein of the first conveyor belts 343 or the second conveyor belts 362, which are O-ring belts, are formed in the circumferential portions of the driving rollers 342 and the second driven rollers 361. More specifically, as shown in FIG. 4, of the three driving rollers 342, one driving roller 342 located at the middle position is formed with one groove, while the two driving rollers 342 located outside are each formed with two grooves. The three first driven rollers 341 and the two second driven rollers 361 are each formed with one groove.

The first driven rollers 341 are disposed at a position where they receive a label 131 after being peeled by the peeling edge 251 in the printer 201. That is, the first conveyor belts support the label 131. The first conveyor belts 343 rotate with rotation of the driving rollers 342, whereby the label 131 is conveyed in the rotating direction of the first conveyor belts 343.

The second conveyor belts 362 also rotate with rotation of the driving rollers 342. Therefore, as long as the rotation of the driving rollers 342 is not stopped, the label 131 having been conveyed by the first conveyor belts 343 continues to be conveyed obliquely downwards while being supported by the second conveyor belts 362. Since both first and second conveyor belts 343, 362 are non-adhesive, the label 131 is conveyed smoothly from the first conveyor belts 343 to the second conveyor belts 362.

On a downstream end in the conveyance direction of the label 131 by the second conveyor belts 362 is disposed a label recovery case 371 (see FIG. 1) capable of receiving the label 131 therein. That is, the second conveyor belt 362 conveys the label 131 toward a label recovery position where the label recovery case 371 is disposed.

Since the second conveyor belts 362 are non-adhesive, the label 131 drops by its own weight during conveyance performed by the second conveyor belts 362. The label 131 thus dropped by its own weight is received into the label recovery case 371 disposed at the label recovery position.

As shown in FIG. 3, a photoelectric type label sensor 351 as a label detecting portion is disposed between the first driven rollers 341 and the driving rollers 342. The label sensor 351 detects the label 131 which has been conveyed by the first conveyor belts 343. Upon sensing the label 131, the label sensor 351 outputs a label detection signal to a label control unit 381 (see FIG. 6).

As shown in FIGS. 3 and 4, a chucking head 311 is disposed at a position above the first conveyor belts 343. The chucking head 311 has a smooth chucking surface 312. Plural through holes 313 indicated by dotted lines are formed in the chucking surface 312. The through holes 313 extend to the interior of the chucking head 311.

The chucking head 311 is held by an arm 321. The arm 321 is connected to a rod 332 of an air cylinder 331. The rod 332 is capable of extension and retraction. The air cylinder 331 is held by a cylinder holding member 334 via a rotary holder 333. By 90° rotation of the rotary holder 333 the air cylinder 331 turns sideways (indicated by a dash-double dot line in FIG. 3) with respect to the cylinder holding member 334.

An air feeder 384 (see FIG. 6) is connected to the air cylinder 331. With air fed from the air feeder 384, the air cylinder 331 can cause the rod 332 to extend. As a result of extension of the rod 332, the chucking head 31 is displaced to a first head position (indicated by a dash-double dot line in FIGS. 3 and 4) where the chucking surface 312 comes into contact with the label 131 supported by the first conveyor belt 343. With retraction of the rod 332, the chucking head 311 rises and reverts to its original position.

The air feeder 384 (see FIG. 6) is connected also to the chucking head 311. When the air feeder 384 operates in the displaced state of the chucking head 311 to the first head position and a negative pressure acts on the through holes 313, the label 131 is chucked by the chucking surface 312 of the chucking head 311 and its sticking surface 131*a* is exposed.

After the chucking head 311 with the label 131 chucked thereto has been restored to its original position by retracting the rod 332, the rotary holder 333 is rotated to turn the air cylinder 331 sideways. A work W is disposed at a position confronting the labeler 301. If in this state the rod 332 is extended to push out the chucking head 311, the chucking head 311 moves to a second head position (indicated by a dash-double dot line in FIG. 5) where the chucking surface 312 comes into contact with the work W. At this time, the negative pressure of the through holes 313 is released and switching is made to the ejection of pressurized air. By the ejection of pressurized air, the chucking of the label 131 by the chucking head 311 is canceled and the label 131 is blown off toward the work W. As a result, sticking of the label 131 to the work W is carried out. The chucking head 311, air cylinder 331 and rotary holder 333 constitute a sticking mechanism for taking out a label 131 on the conveyor belts 343 and sticking it to the work W. Sticking of the label 131 to the work W may be done by a compression bonding method not using air.

Figure 5:
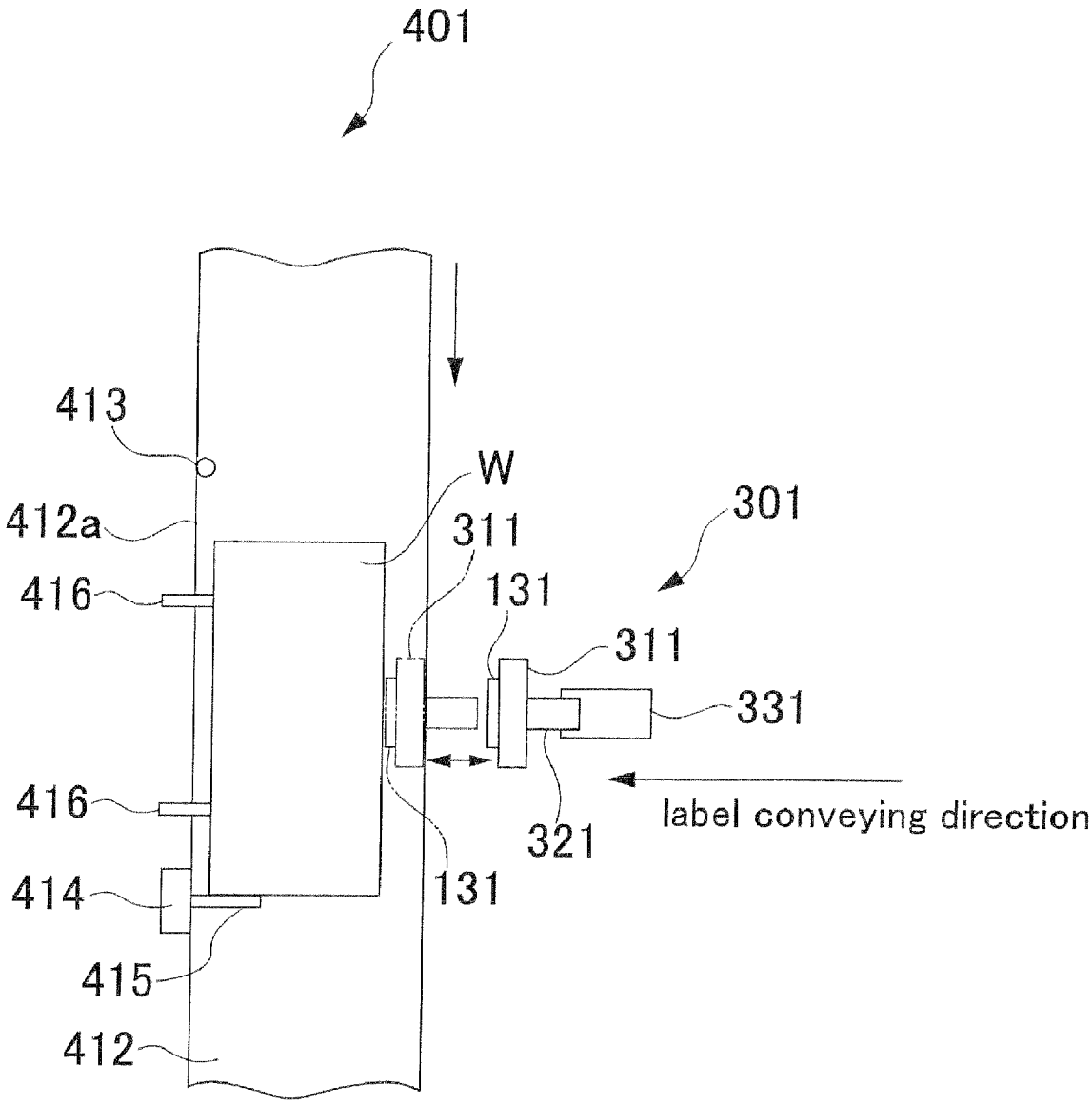
FIG. 5 is a plan view showing a relation between the labeler and a conveyor unit.

FIG. 5 is a plan view showing a relation between the labeler 301 and the work conveying unit 401. The work conveying unit 401 includes a conveyor belt 412. With the conveyor belt 412 the work W is conveyed in a direction orthogonal to the label conveying direction to a position confronting the labeler 301. The conveyor belt 412 rotates with rotation of a conveyor belt conveying roller 411 (see FIG. 1), whereby the work W placed on the conveyor belt 412 is conveyed.

A work sensor 413 is disposed on an upper surface side of the conveyor belt 412. The work sensor 413 detects the passing of the work W and outputs a work passing signal to the label control unit 381. A product stopper 414 is disposed on the upper surface side of the conveyor belt 412 and downstream of the work sensor 413 in the conveyance direction of the work W. The product stopper 414 holds a stopper rod 415 extensibly and retractably to and from the conveyor belt 412 side. As shown in FIG. 5, in an extended state of the stopper rod 415, the work W comes into contact with the stopper rod 415 and the conveyance thereof is stopped. As a result, the work W is held at a position confronting the labeler 301. At this time, the rotation of the conveyor belt 412 is riot stopped.

Sticking of the label 131 is performed to the work W whose conveyance is stopped. At a position opposite to and confronting the labeler 301 with the conveyor belt 412 held therebetween, there are fixedly disposed work holding pieces 416 for preventing dislocation of the work W at the time of sticking of the label 131.

Figure 6:
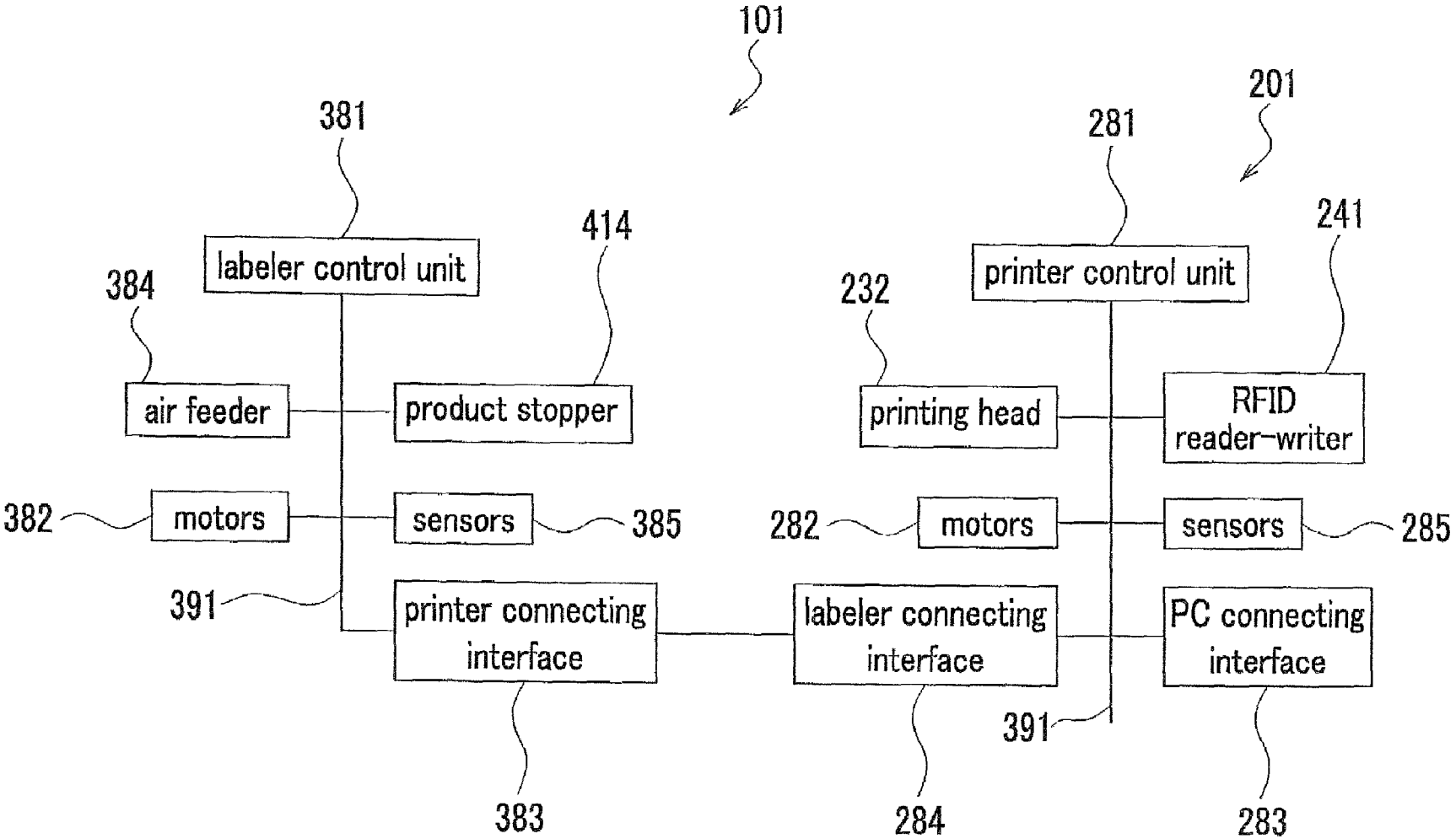
FIG. 6 is a block diagram showing an electrical connection of the printer-labeler.

FIG. 6 is a block diagram showing an electrical connection of the printer-labeler 101.

Printer-labeler 101 includes a controller. The controller comprises a printer control unit 281 and a labeler control unit 381.

The printer 201 includes the printer control unit 281 of a microcomputer configuration. The printer control unit 281 includes CPU, ROM and RAM (none of them are shown). The printing head 232, RAID reader-writer 241, various motors 282, various sensors 285, PC connecting interface 283 and labeler connecting interface 284 are connected to the printer control unit 281 via a bus line 291. The PC connecting interface 283 connects the printer control unit 281 and PC (not shown) with each other so as to permit data communication. The labeler connecting interface 284 connects the printer 201 and the labeler 301 with each other so as to permit data communication. The motors 282 include motors as drive sources for the conveying rollers 221, ribbon take-up shaft 235 and base paper take-up shaft 222. The sensors 285 include a sensor (not shown) which is disposed in the conveyance path of the label paper 111 to detect passing of the label 131.

The printer control unit 281 receives RFID data and printing data from PC and store them in a buffer. Further, the printer control unit 281 makes control so that a label issue request for the number of labels based on the received RFID data and printing data is stored in the buffer.

The labeler 301 includes the labeler control unit 381 of a PLC configuration. The air feeder 384, product stopper 414, printer connecting interface 383, various motors 382 and various sensors 385 are connected to the labeler control unit 381 via a bus line 391. The printer connecting interface 383 connects the labeler 301 and the printer 201 with each other so as to permit data communication. The motors 382 include motors as drive sources for the driving rollers 342, rotary holder 333 and conveyor belt conveying roller 411. The sensors 385 include a label sensor 351 and a work sensor 413.

The labeler control unit 381 makes data communication with the printer control unit 281 to check the label issue request stored in the printer control unit 281. When there is the label issue request, the label control unit 381 outputs a conveyance command to the printer control unit 281.

Now, with reference to FIGS. 7 and 8, a description will be given below about a flow of processes carried out by the printer-labeler 101 of this embodiment having the above configuration.

Figure 7:
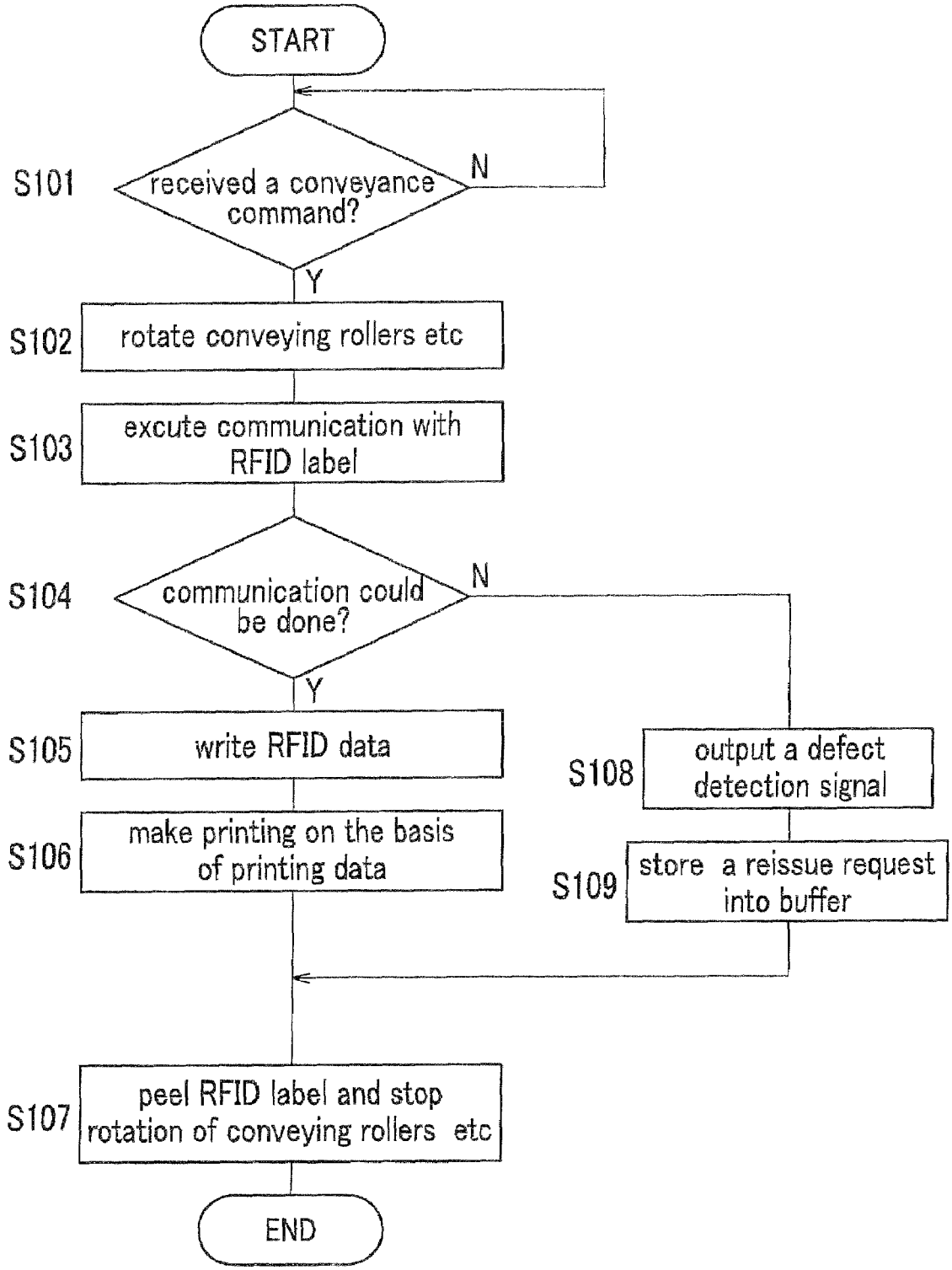
FIG. 7 is a flow chart showing a flow of processes carried out by a printer.

FIG. 7 is a flow chart showing a flow of processes carried out by the printer 201. The printer control unit 281 waits for the reception of a conveyance command outputted from the labeler 301 (step S101). At this time, both RFID data and printing data transmitted from PC are stored in the buffer of the printer control unit 281.

Upon receipt of the conveyance command (Y in step S101) the printer control unit 281 turns ON the motors 282. As the conveying rollers 221, etc. rotate with operation of the motors 282, the conveyance of the label paper 111 is started (step S102).

When a label 131 conveyed together with the label paper 111 has been positioned above the RFID reader-writer 241, the printer control unit 281 controls the RFID reader-writer 241 to make communication between the label 131 and the RFID tag 132 (step S103). In this embodiment the communication with the RFID reader-writer 241 is performed under conveyance of the label 131, the conveyance of the label 131 may be stopped during the communication.

If the communication between the label 131 and the RFID tag 132 could be done in step S103 (Y in step S104), the printer control unit 281 controls the RFID reader-writer 241 to write the RFID data stored in the buffer to the label 131 (step S105) Subsequently, the printer control unit 281 controls the printing head 232 to make printing to the printing surface 131*b* of the label 131 on the basis of the printing data stored in the buffer (step S106). Then, the printer control unit 281 causes the label paper 111 to be conveyed up to the position where the label 131 is peeled by the peeling edge 251 and causes the conveying rollers 221, etc. to stop rotation (step S107). The label 131 is peeled by the peeling edge 251 and is then supported by the first conveyor belts 343 in the labeler 301. At this time, the first conveyor belts 343 are rotating.

If the communication with the label 131 in step S103 is infeasible (N in step S104), the printer control unit 281 determines that the RFID tag 132 is not proper and detects a defect of the label 131, then outputs a defect detection signal to the labeler 301 (step S108). In this way there is realized the function of a defect detection section such that a defect detection signal is outputted to the labeler 301 upon detection of a defect of the label 131 on the label paper 111. The labeler control unit in the labeler 301 receives the defect detection signal and stores it to the buffer.

Next, the printer control unit 281 stores a reissue request as a label issue request into its own buffer (step S109) The reason is that write of RFID data and printing are not carried out for the label 131 found defective and that therefore retrial is needed for the next label 131.

Next, as is the case with the communication with the label 131 being feasible, that is, as is the case with the label 131 being normal, the printer control unit 281 causes the label paper 111 to be conveyed up to the position where the label 131 is peeled by the peeling edge 251 and causes the conveying rollers 221, etc. to stop rotation (step S107). After being peeled by the peeling edge 251, the label 131 is supported by the first conveying belts 343 in the labeler 301. In this embodiment it is determined whether the label 131 is an abnormal label or not on the basis of whether the communication between the RFID tag 132 of the label 131 and the RFID reader-writer 241 could be done or not before write of the RFID data. The determination whether the label 131 is an abnormal label or not may be done such that, after write of the RFID data, the communication between the RFID reader-writer and the label 131 is performed to check whether the write is done normally.

Figure 8:
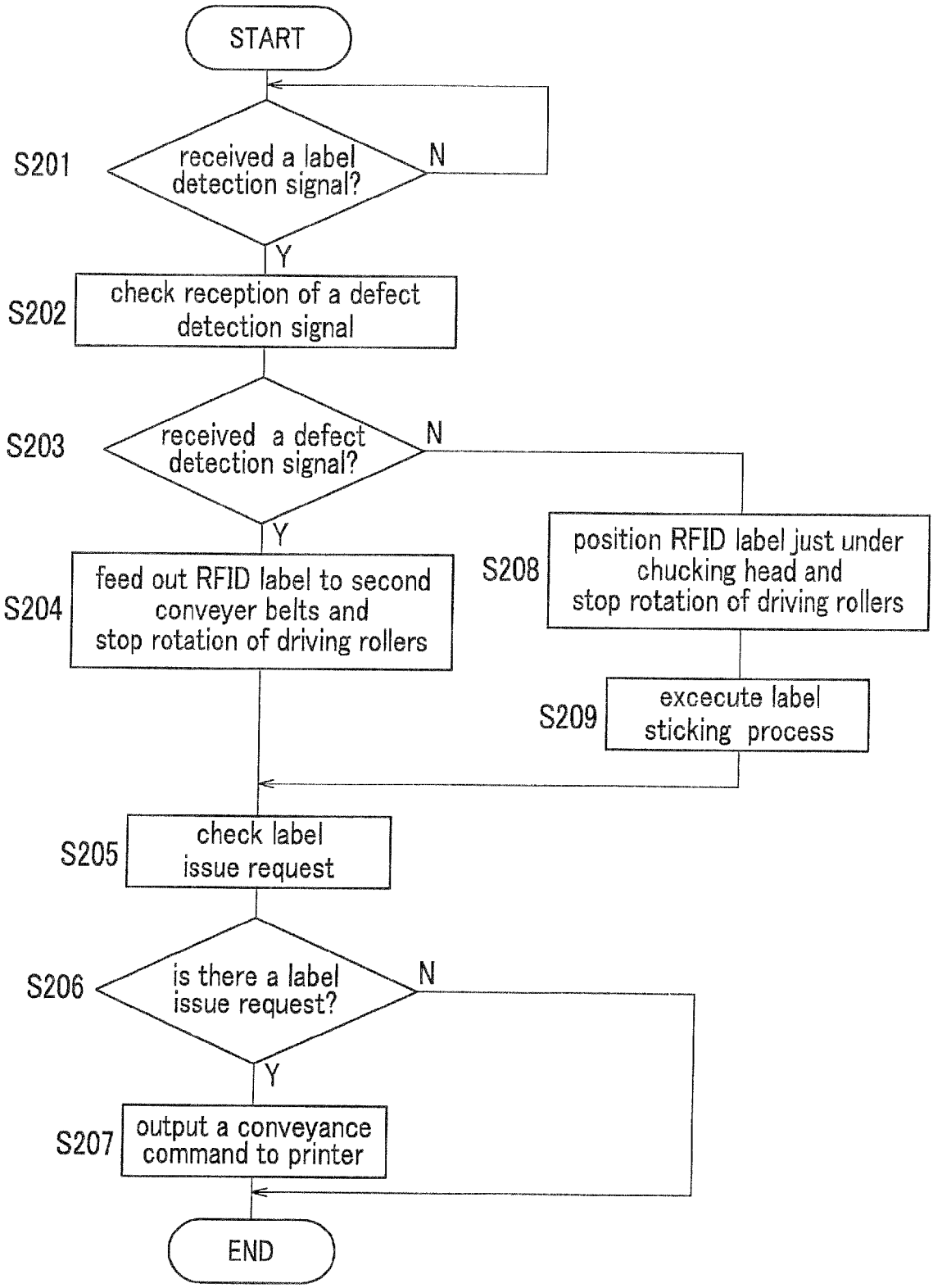
FIG. 8 is a flow chart showing a flow of processes carried out by the labeler.

FIG. 8 is a flow chart showing a flow of processes carried out by the labeler 301. The labeler control unit 381 in the labeler 301 causes the motors 382 to operate, thereby rotating the driving rollers 342. The first and second conveyor belts 343, 362 rotate with rotation of the driving rollers 342. The label 131 peeled by the peeling edge of the printer 201 is conveyed by the first conveyor belts 343. While being conveyed by the first conveyor belts 343, the label 131 is detected by the label sensor 351. Upon detection of the label 131 the label sensor 351 outputs a label detection signal to the labeler control unit 381.

Upon making sure of the reception of the label detection signal outputted from the label sensor 351 (Y in step S201) the label control unit 281 checks the reception of a defect detection signal (step S202). More specifically, it is determined whether the reception of a defect detection signal is stored in the own buffer.

As a result of checking the reception of the defect detection signal in step S202, if the same signal is not received (N in step S203), it is determined that the label 131 detected by the label sensor 351 is normal. Once it is determined that the label 131 is normal, ordinary processings are executed. First, the labeler control unit 381 controls the motors 382 to stop rotation of the driving rollers 342. When the conveyance of the label 131 is stopped by the stop of rotation of the driving rollers 342, the label 131 is positioned just under the chucking head 311 (step S208). Next, the labeler control unit 381 executes a label sticking process (step S209).

The label sticking process is a process wherein the label 131 positioned just under the chucking head 311 is stuck to the work W. In the label sticking process, the air feeder 384 as a drive source for the air cylinder 331 and the chucking head 311, as well as the motors 382 as a drive source for the rotary holder 333, are operated.

Once the label sticking process is started, first the rod 332 is extended, whereby the chucking head 311 moves to the first head position. Then, a negative pressure is exerted on the through holes 313, whereby the label 131 is chucked to the chucking surface 312 of the chucking head 311. Next, the rod 332 reverts to its original position, so that the chucking head 311 rises while chucking the label 131. Thereafter, the rotary holder 333 is rotated and the air cylinder 331 turns sideways. In this state, the rod extends again, whereby the chucking head 311 moves to the second head position. At this time, the negative pressure is released, so that the label 131 chucked to the chucking surface 312 is dechucked. In this way the label sticking process is carried out, whereby the label 131 is stuck to the work W.

During execution of the label sticking process the labeler control unit 381 keeps the stopper rod 415 extended by controlling the product stopper 414. With the extended stopper rod 415, the work W is stopped at the position confronting the labeler 301. When the label sticking process is over, the labeler control unit 381 controls the product stopper 414 to cancel the extended state of the stopper rod 415, whereupon the work W with the label 131 stuck thereon is conveyed to the next process by the conveyor belt 412.

After execution of the label sticking process (step S209), the labeler control unit 381 checks whether there is a label issue request (step S205). If the printer control unit 281 stores a label issue request (Y in step S206), the label control unit 381 outputs a conveyance command to the printer 201 (step S207). If there is no label issue request (N in step S206) the label control unit 381 terminates the process.

On the other hand, as a result of checking a defect detection signal in step S202, if the same signal is received (Y in step S203), the label control unit 381 controls the motors 382 to continue rotation of the driving rollers 342, allowing the label 131 to be fed out onto the second conveyor belts 362, then causes the rotation of the driving rollers 342 to be stopped (step S204). The label 131 thus fed out onto the second conveyor belts 362 drops by its own weight during conveyance by the belts 362 and is received into the label recovery case 371.

Next, the label control unit 381 checks whether there is a label issue request (step S205). At this time the printer control unit 281 ought to store a reissue request as a label issue request (see step S109 in the flow chart of FIG. 7). If there is such a label issue request (Y in step S206), the label control unit 381 outputs a conveyance command based on the reissue request to the printer 201 (step S207). As a result, write and printing of RFID data which were not carried out last time are carried out for the next label 131.

According to this embodiment, as described above, the label 131 found defective is conveyed toward the label recovery case 371 without being chucked by the chucking head 311. Thus, the label 131 found defective can be removed positively without the need of such a complicated mechanism as causes the chucking head 311 to move to a position different from the position of the work W.

Besides, since there is adopted a configuration of removing the abnormal label 131 without using the chucking head 311, namely, without using a configuration for sticking the label 131 to the work W, the sticking process can be done even during removal of the abnormal label. Consequently, the processing time can be shortened as a whole.

Moreover, as means for removing an abnormal label there is adopted a configuration the second conveyor belts 362 which are inclined so as to have an inward conveyance direction are installed continuously with the first conveyor belts 343. Thus, an abnormal label can be removed by a simpler configuration.

Although in the above embodiment a label 131 incapable of write of RFID data is determined to be an abnormal label, there may be adopted a method wherein the result of printing on a label 131 is read using a scanner or the like after the printing process and if the result of printing is not proper, the label 131 concerned is determined to be an abnormal label, followed by execution of the processing for removing the abnormal label.

The present invention is applicable also to the case where printing is made to a label not having RFID tag 132. In this case, the result of printing is checked in the same manner as above and if it is not proper, the label concerned is determined to be an abnormal label, followed by the label removing process. Thus, the RFID reader-writer 241 is not essential to the construction of the present invention.

Obviously, numerous modifications and variations of the present invention are possible in light of the above teachings. It is therefore to be understood that within the scope of the appended claims, the invention may be practiced otherwise than as specifically described herein.

What is claimed is:

1. A printer-labeler, comprising:

a conveying unit which conveys label paper comprising a base paper having labels affixed thereto;

a printing unit which performs printing on the labels;

a label peeling unit which is disposed downstream of the printing unit in a label paper conveying direction and which peels from the base paper a label from among the labels affixed to the base paper in a label paper conveying process;

a conveyor belt which conveys the label peeled by the label peeling unit toward a predetermined label recovery position;

a sticking mechanism which removes the label from the conveyor belt and which sticks the label to a work at a predetermined position; and a label sensor which detects the label on the conveyor belt;

a controller which executes:

a processing to perform a label sticking process comprising controlling the sticking mechanism to remove the label from the conveyor belt and to stick the label to the work at the predetermined position, when the label sensor detects the label;

a processing to detect a defect of the label on the conveyor belt before the label sensor detects the label; and a processing to control a drive source of the conveyor belt to convey the label to the label recovery position without carrying out the label sticking process, when the processing to detect a defect of the label detects a defect of the label;

wherein the conveyor belt passes a position at which the sticking mechanism removes the label from the conveyor belt.

2. A printer-labeler according to claim 1, wherein the conveyor belt includes a first conveyor belt which conveys the peeled label to the position where it is removed by the sticking mechanism, and a second conveyor belt which is connected to the first conveyor belt and which conveys the peeled label downward to the label recovery position.

3. A labeler, comprising:

a conveyor belt which conveys a label peeled from label paper toward a predetermined label recovery position;

a sticking mechanism which removes the label from the conveyor belt and which sticks the label to a work at a predetermined position; and a label sensor which detects the label on the conveyor belt;

a controller which executes:

a processing to perform a label sticking process comprising controlling the sticking mechanism to remove the label from the conveyor belt and to stick the label to the work at the predetermined position;

a processing to detect a defect of the label on the conveyor belt before the label sensor detects the label; and a processing to control a drive source of the conveyor belt to convey the label to the label recovery position without carrying out the label sticking process, when the processing to detect a defect of the label detects a defect of the label;

wherein the conveyor belt passes a position at which the sticking mechanism removes the label from the conveyor belt.

4. A labeler according to claim 3, wherein the conveyor belt includes a first conveyor belt which conveys the peeled label to the position where it is removed by the sticking mechanism, and a second conveyor belt which is connected to the first conveyor belt and which conveys the peeled label downward to the label recovery position.

5. A printer-labeler according to claim 1, further comprising:

a unit which conveys the work in a direction perpendicular to the label paper conveying direction.

6. A labeler according to claim 3, further comprising:

a unit which conveys the work in a direction perpendicular to a label conveying direction.

7. A label conveying method, comprising:

conveying label paper comprising a base paper having labels affixed thereto;

performing printing on the labels;

peeling from the base paper a label from among the labels affixed to the base paper in a label paper conveying process;

conveying, by a conveyor belt, the peeled label toward a predetermined label recovery position;

detecting, by a label sensor, the label on the conveyor belt;

removing, by a sticking mechanism, the label from the conveyor belt and sticking the label to a work at a predetermined position when the label sensor detects the label;

detecting a defect of the label on the conveyor belt before the label sensor detects the label; and controlling a drive source of the conveyor belt to convey the label to the label recovery position without performing the label sticking process, when a defect of the label is detected;

wherein the conveyor belt passes a position at which the sticking mechanism removes the label from the conveyor belt.

* * * * *